US005857445A

United States Patent [19]

Shimada et al.

[11] Patent Number: 5,857,445

[45] Date of Patent: Jan. 12, 1999

[54] ENGINE CONTROL DEVICE

[75] Inventors: Kousaku Shimada; Takeshi Atago, both of Hitachinaka, Japan

[73] Assignee: Hitachi, Ltd., Japan

[21] Appl. No.: 703,358

[22] Filed: Aug. 26, 1996

[30] Foreign Application Priority Data

Aug. 24, 1995 [JP] Japan ..... 7-216302

[51] Int. Cl.[6] ..... F02D 41/04

[52] U.S. Cl. ..... 123/492; 123/478; 123/681

[58] Field of Search ..... 123/419, 436, 123/492, 493, 478, 681, 682

[56] References Cited

U.S. PATENT DOCUMENTS

| | | | |
|---|---|---|---|
| 4,571,683 | 2/1986 | Kobayashi et al. | 123/674 X |
| 4,633,841 | 1/1987 | Matsuura et al. | 123/492 |
| 4,640,254 | 2/1987 | Ninomiya | 123/492 |
| 4,825,838 | 5/1989 | Osuga et al. | 123/681 |
| 5,014,668 | 5/1991 | Klenk et al. | 123/399 |
| 5,413,078 | 5/1995 | Mitsunaga et al. | 123/492 |
| 5,483,939 | 1/1996 | Kamura et al. | 123/492 |
| 5,666,916 | 9/1997 | Fujieda et al. | 123/295 |

*Primary Examiner*—Tony M. Argenbright
*Attorney, Agent, or Firm*—Evenson, McKeown, Edwards & Lenahan, P.L.L.C.

[57] ABSTRACT

An engine control device for controlling an air-fuel ratio of an engine, wherein an air-fuel ratio is set at 24 when an output torque of the engine is not more than a first point. It is changed from the value of 24 toward a stoichiometric ratio in accordance with a magnitude of the output torque when the output torque of the engine is in a range of from the first point to a second point and it is set at the stoichiometric ratio (14.7) when the output torque of the engine is more than the second point.

6 Claims, 10 Drawing Sheets

EP-ROM
27
MPU
28
RAM
29
15
I/O LSI
30
FUEL INJECTION VALVE
13a
FUEL INJECTION VALVE
13f
IGNITION COIL
17
FUEL PUMP
10
TI
AIR FLOW SENSOR
3
CRANK ANGLE SENSOR
19
REF, POS
IDLING SWITCH
26
STARTER SWITCH
24
AIR-FUEL RATIO SENSOR
20
WATER TEMPERATURE SENSOR
22
BATTERY
25
THROTTLE SENSOR
18
θTH

FIG. 7

| Ne (rpm) \ Qa (kg/h) | 20 | 40 | 60 | 80 | 100 | 120 | 140 | 160 |
|---|---|---|---|---|---|---|---|---|
| 0 | 14.7 | 24 | 22 | 20 | 14.7 | 14.7 | 14.7 | 14.7 |
| 1000 | 14.7 | 24 | 22 | 20 | 14.7 | 14.7 | 14.7 | 14.7 |
| 2000 | 14.7 | 24 | 24 | 22 | 20 | 14.7 | 14.7 | 14.7 |
| 3000 | 14.7 | 24 | 24 | 23 | 20 | 14.7 | 14.7 | 14.7 |
| 4000 | 14.7 | 24 | 24 | 24 | 22 | 20 | 14.7 | 14.7 |
| 5000 | 14.7 | 24 | 24 | 24 | 22 | 20 | 14.7 | 14.7 |

D C

| Ne (rpm) \ Tp (ms) | 0 | 1 | 2 | 3 | 4 | 5 | 6 | 7 |
|---|---|---|---|---|---|---|---|---|
| 0 | 14.7 | 24 | 24 | 24 | 22 | 20 | 14.7 | 14.7 |
| 1000 | 14.7 | 24 | 24 | 24 | 22 | 20 | 14.7 | 14.7 |
| 2000 | 14.7 | 24 | 24 | 24 | 24 | 22 | 20 | 14.7 |
| 3000 | 14.7 | 24 | 24 | 24 | 24 | 22 | 20 | 14.7 |
| 4000 | 14.7 | 24 | 24 | 24 | 22 | 20 | 14.7 | 14.7 |
| 5000 | 14.7 | 24 | 24 | 24 | 22 | 20 | 14.7 | 14.7 |

ENGINE CONTROL DEVICE

FIELD OF THE INVENTION

The present invention relates to an engine control device used for gasoline engines of automobiles, and particularly to an engine control device suitable for a lean burn gasoline engine.

BACKGROUND OF THE INVENTION

In recent years, there is growing interest in a lean burn engine for improving the fuel consumption of automobiles, and various types of lean burn engines have been proposed, for example, as described in Japanese Patent Laid-open No. Hei 6-88562.

A lean burn engine is not necessarily operated in a lean burn state over the entire operating region but is operated at an air-fuel ratio switched between a lean ratio state and a stoichiometric ratio state in accordance with an operational condition.

The lean burn engine described in the above document, Japanese Patent Laid-open No. Hei 6-88562, is operated at an air-fuel ratio switched from a lean ratio state to a stoichiometric ratio state when an engine load is more than a load limit in the lean ratio state. The load limit in the lean ratio state is lower than that of the stoichiometric ratio state. The reason for this is as follows:

Since a necessary fuel amount is little changed when an engine load or an engine torque is not changed, a necessary intake air amount is increased linearly with an air-fuel ratio at the same engine torque. Accordingly, the lean ratio state requires an air mount larger than the stoichiometric ratio state does.

On the other hand, the limit of the maximum intake air amount upon full open of a throttle valve is determined on the basis of an engine speed because the engine structure is not changed, so that the operable load limit in the lean ratio state is made smaller than that in the stoichiometric ratio state. The engine is not operated in the lean ratio state when the engine load is more than the load limit in the lean ratio state. As a result, in the related art, when the engine load is more than the load limit in the lean ratio state, the engine is operated in the stoichiometric ratio state switched from the lean ratio state. Such a technique fails to sufficiently take into consideration the enlargement of the lean burn operating region, and to obtain the fuel consumption of an engine expected to be improved due to lean burn operation of the engine.

Namely, in the related art, since the lean burn operation is directly switched to the stoichiometric burn operation when an engine load is more than a load limit in the lean ratio state, the ratio of the stoichiometric burn operation to the lean burn operation becomes large in the case of an engine of an automobile, that is, in the case where a load constant state such as cruising operation and a high load state such as accelerating operation are frequently repeated. As a result, it fails to sufficiently improve the fuel consumption of an engine due to lean burn operation.

SUMMARY OF THE INVENTION

An object of the present invention is to provide an engine control device for a lean burn engine of an automobile, which is capable of improving the fuel consumption of the engine due to lean burn operation even when a load constant state is relatively frequently changed to a high load state.

To achieve the above object, according to the present invention, there is provided a control means for changing an air-fuel ratio in a lean ratio state into a value in a stoichiometric ratio state, in a lean burn engine operated at an air-fuel ratio of the engine switched between the stoichiometric ratio state and the lean ratio state, wherein the air-fuel ratio of the engine is changed toward a stoichiometric ratio in accordance with the increased degree of an engine load when the engine load is more than a specified value during operation of the engine in the lean ratio state.

As a result, even in a high load region where an engine load is more than a load limit in the lean ratio state and thereby an engine must be operated in the stoichiometric ratio state in the related art, the fuel supply amount is increased without a change in an air amount for changing an air-fuel ratio in the lean ratio state toward the stoichiometric ratio state in accordance with the increased degree of an engine load when the engine load is more than the specified value. The engine can be thus operated in the lean ratio state.

This is advantageous in that a region enabling lean burn operation excellent in fuel consumption is extended, to thereby improve the fuel cost.

Other objects, advantages and novel features of the present invention will become apparent from the following detailed description of the invention when considered in conjunction with the accompanying drawings.

BRIEF DESCRIPTION OF THE DRAWINGS

FIG. 7 shows an air-fuel map used for the control of the first embodiment of the present invention;

DETAILED DESCRIPTION OF THE PREFERRED EMBODIMENTS

Hereinafter, preferred embodiments of the present invention will be described with reference to the drawings.

Figure 1:
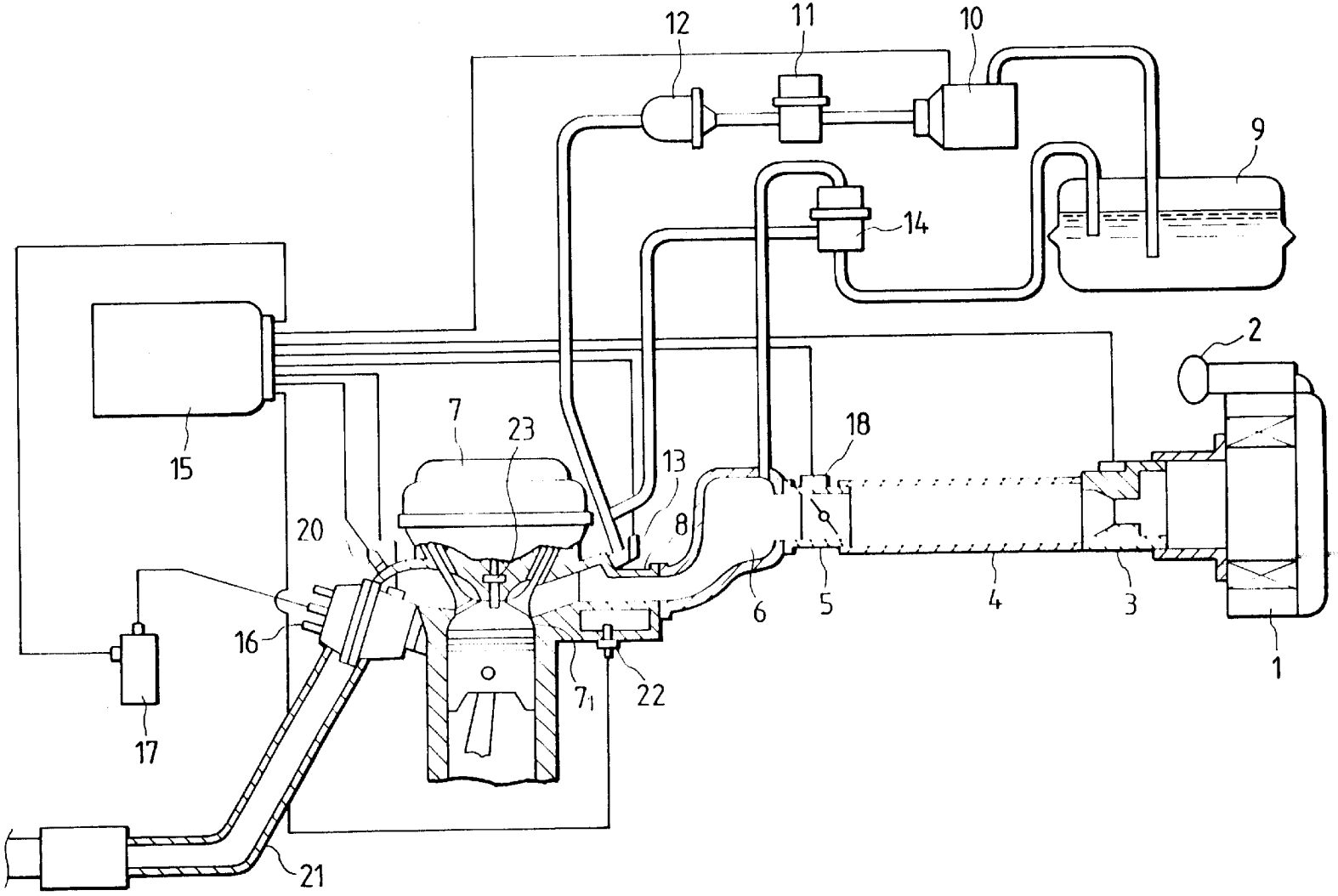
FIG. 1 is a diagram showing the configuration of an engine control system for carrying out a control technique of the present invention.

FIG. 1 is a view showing the configuration of an engine control system for carrying out a control technique of the present invention. Referring to FIG. 1, an intake air for an engine 7 is sucked from an inlet 2 of an air cleaner 1, passing through an air flow sensor 3, an air piping 4, and a throttle valve body 5 containing a throttle valve for controlling an air flow, and enters a collector 6. The intake air is distributed into intake pipes 8 connected to a plurality of cylinders 71 of the engine 7, and is introduced into each of the cylinders 71.

A fuel such as gasoline is sucked from a fuel tank 9 in a pressurized state by a fuel pump 10 and is supplied into each cylinder 71 through a fuel damper 11, a fuel filter 12, a fuel injection valve 13, a fuel pressure regulator 14. The fuel is adjusted in pressure at a specified value by the pressure regulator 14 and is injected from the fuel injection valve 13 provided in the intake pipe 8 into the intake pipe 8. The injection timing of the fuel is controlled by a control unit 15.

In this embodiment, the fuel injection valve 13 is mounted in the intake pipe 8; however, it may be mounted in a cylinder block of the engine 7 for directly injecting a fuel into each cylinder 71 (in-cylinder injection type).

A signal indicating a flow rate of an intake air is supplied from the air flow sensor 3 into the control unit 15.

A throttle sensor 18 for detecting an opening degree of a throttle valve is mounted in the throttle valve body 5. A signal indicating an opening degree of the throttle valve is supplied from the throttle sensor 18 into the control unit 15.

An air-fuel mixture containing the fuel mixed with the intake air flowing in the cylinder 17 is ignited and exploded by spark of an ignition plug 23, to thus operate the engine. The ignition timing of the ignition plug 23 is controlled on the basis of a signal supplied from the control unit 15. The signal is transmitted from the control unit 15 to a distributor 16 by way of an ignition coil.

A crank angle sensor 19 (not shown) is contained in the distributor 16 for outputting a reference angle signal REF indicating a rotational position of a crank shaft of the engine 7 and an angle signal POS for detecting a rotational speed of the crank shaft. These signals are inputted into the control unit 15.

An air-fuel ratio sensor 20 is mounted in an exhaust pipe 21. A signal outputted from the air-fuel ratio sensor 20 is supplied to the control unit 15. The air-fuel ratio sensor 20, used to detect an actual air-fuel ratio of the engine 7, has two types of: detecting an air-fuel ratio in a wide region from a stoichiometric ratio to a lean air-fuel ratio; and detecting a large or small change of air-fuel ratio on the basis of a specified value.

A water temperature sensor 22 for measuring a temperature of cooling water for the engine 7 is provided in the engine 7. A signal outputted from the water temperature sensor 22 is supplied to the control unit 15 for checking whether or not the engine 7 is just started.

Figure 2:
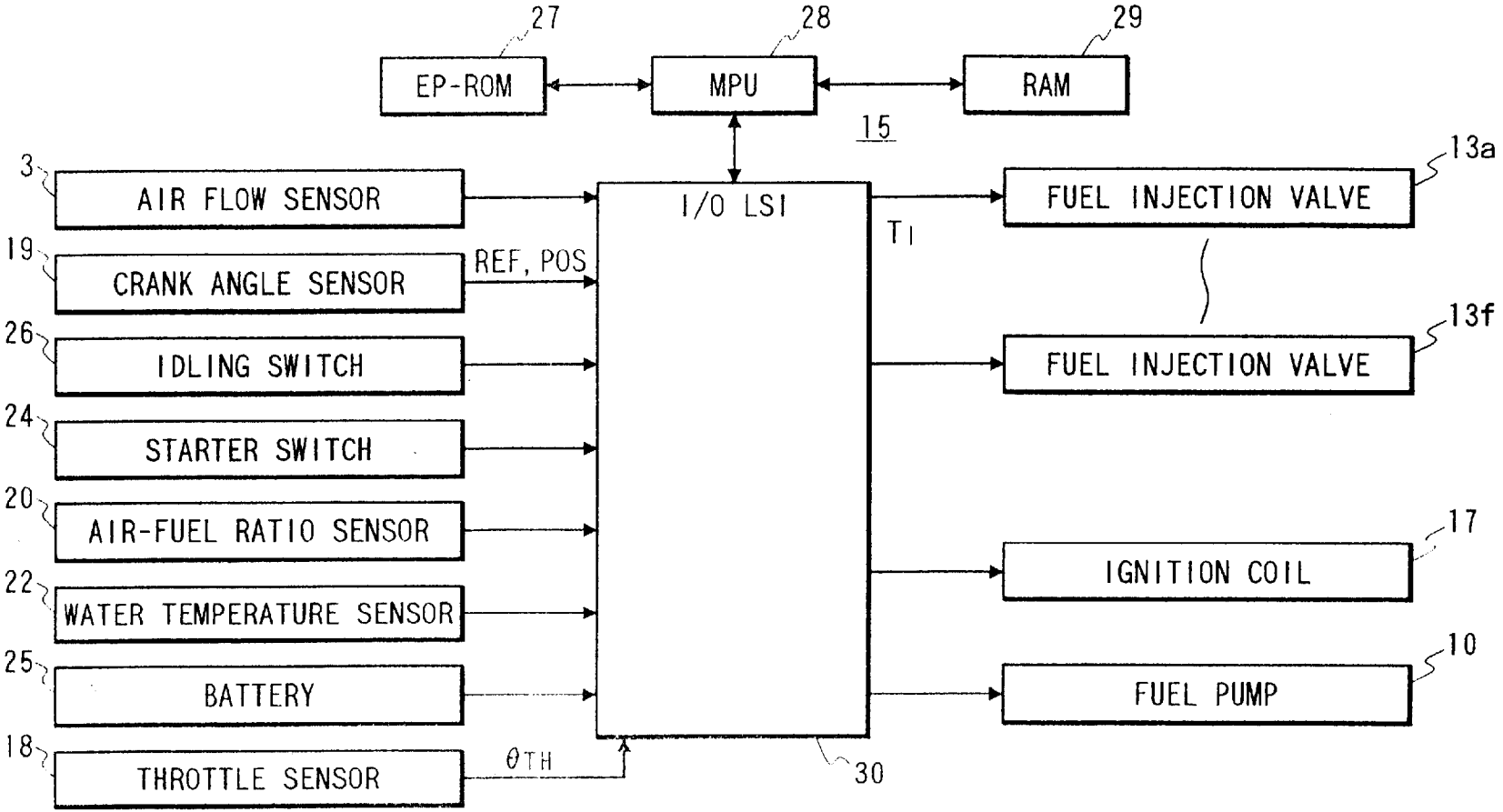
FIG. 2 is a diagram illustrating input and output signals in and from an electronic control unit provided in the engine control system shown in FIG. 1.

FIG. 2 is a diagram illustrating input and output signals in and from the electronic control unit provided in the engine control system shown in FIG. 1.

A major portion of the control unit 15 includes an EP-ROM (Erasable Programmable Read-Only Memory) 27, a MPU (Micro Processing Unit) 28, a RAM (Random Access Memory) 29, and an I/O LSI (Input-Output Large Scale Integration) 30 for receiving signals from the various sensors for detecting operating conditions of the engine, executing a specified computing operation on the basis of a computing program stored therein, and outputting a control signal thus calculated. Examples of signals inputted into the control unit 15 include a signal indicating a flow rate of an intake air, which is supplied from the air flow sensor 3; a reference angle signal REF indicating a rotational position of the crank shaft of the engine 7 and an angle signal POS for detecting a rotational speed of the crank shaft, which is supplied from the crank angle sensor 19; a signal indicating whether or not the engine is in an idling state, which is supplied from an idling switch 26; a signal indicating whether or not a starter of the engine 7 is operated, which is supplied from a starter switch 24; a signal indicating an air-fuel ratio or an oxygen concentration in an exhaust gas, which is supplied from the air-fuel ratio sensor 20; a signal indicating a temperature of cooling water, which is supplied from the water temperature sensor 22; a signal indicating a battery voltage, which is supplied from a battery 25; and a signal θ TH indicating an opening degree of the throttle valve, which is supplied from the throttle sensor 18.

Examples of signals outputted from the control unit 15 include a signal indicating a fuel injection timing, which is supplied to each of a plurality of the fuel injection valves 13; a signal indicating an ignition timing of the ignition plug 23, which is supplied to the ignition coil 17; and a signal for keeping a fuel pressure at a specified value, which is supplied to the fuel pump 10.

Incidentally, as is well-known, when an air-fuel ratio is shifted to a lean ratio region while an engine torque and an engine speed are kept constant, an intake air amount is increased. This is effective to improve fuel consumption rate and hence to reduce a fuel cost. However, in such a state that an air-fuel ratio of an air-fuel mixture is shifted from a stoichiometric ratio to a lean ratio region in the engine, a concentration of an exhaust gas component and a combustion stability are changed as shown in FIG. 3.

First, as an air-fuel ratio is shifted to the lean ratio region, an air amount is increased and a combustion temperature is lowered, so that an exhaust concentration of nitrogen oxide NOx is reduced. On the other hand, as an airfuel ratio is shifted to the lean ratio region, the ignitionability of the air-fuel mixture is degraded because the ratio of a fuel amount to an air mount is lowered. As an air-fuel ratio is shifted to a lean ratio region, the combustion stability expressed by a magnitude of a torque variation $\Delta\tau$ is gradually degraded until the air-fuel ratio reaches a specified value. After the air-fuel ratio exceeds the specified value, the ignitionability is significantly lowered and thereby the combustion stability is degraded over an allowable upper limit.

In this way, the exhaust concentration of NOx and the combustion stability are largely dependent on the value of the air-fuel ratio in a lean ratio region.

Figure 3:
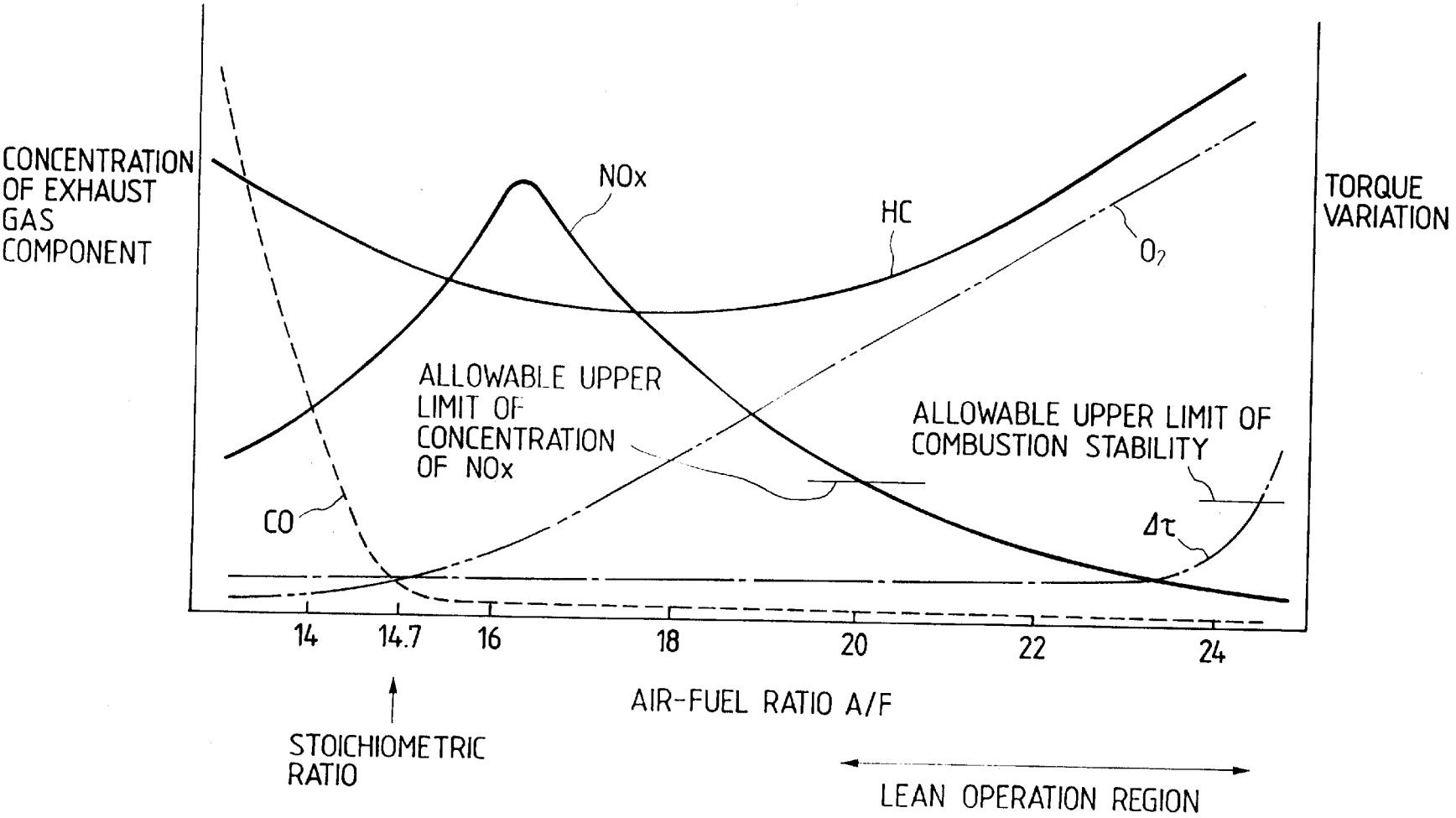
FIG. 3 is a graph showing relationships of a concentration of an exhaust gas component and a variation in torque to an air-fuel ratio.

In FIG. 3, the concentration of NOx is maximized at a point in the lean ratio region near the stoichiometric ratio (14.7). Such a high concentration of NOx in this region has no problem in practical use because NOx can be effectively removed using a three way catalyst. However, since a ratio of purification of NOx through the three way catalyst is made poor in the lean ratio region, the exhaust concentration of NOx must be suppressed. Accordingly, when the air-fuel ratio for operation of an engine lies just before a value corresponding to the allowable limit of combustion stability, the fuel cost is improved and the exhaust amount of NOx is reduced. As can be seen from FIG. 3, the air-fuel ratio suitable for lean burn operation lies just before the value of 24 at which the torque variation $\Delta\tau$ is abruptly increased.

Figure 4:
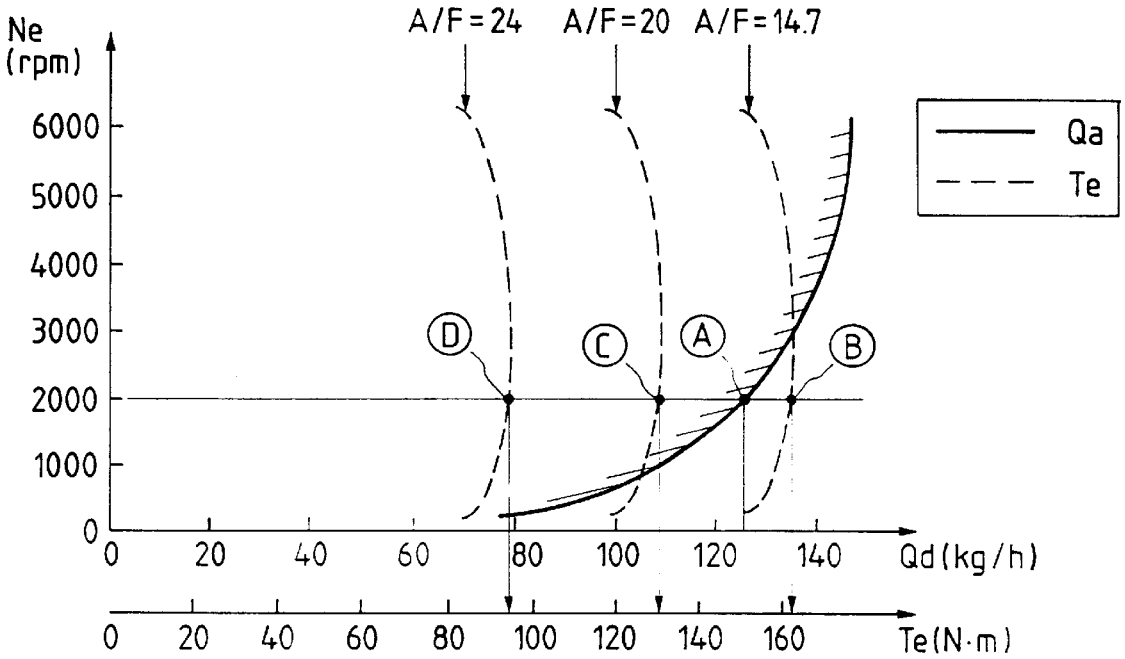
FIG. 4 is a graph showing a limited lean load for each air-fuel ratio.

FIG. 4 is a graph showing a limit load in lean burn operation for each air-fuel ratio, in which the ordinate indicates an engine speed Ne and the abscissa indicates each of the maximum intake air amount Qa of an engine and the maximum output torque Te of the engine; and an air-fuel ratio A/F is taken as a parameter.

The maximum intake air amount Qa upon full open of a throttle valve for each engine speed is shown by a solid line in FIG. 4. For example, a point A indicates the maximum intake air amount Qa at the engine speed Ne=2000 rpm.

The maximum output torque Te upon full open of the throttle valve for each engine speed is shown by a dotted line in FIG. 4. In this figure, three kinds of characteristics with respect to three air-fuel ratios are shown. For example, when the engine speed Ne is set at 2000 rpm (in this case, the maximum intake air amount Qa is indicated at the point A as described above), a torque indicated at a point B can be obtained for the air-fuel ratio A/F =14.7; a torque indicated at a point C can be obtained for the air-fuel ratio A/F=20; and only a torque indicated at a point D can be obtained for the air-fuel ratio A/F=24.

If the air-fuel ratio A/F in lean burn operation is fixedly set at 24 on the basis of the relationships of the concentration of NOx and the allowable limit of combustion stability to an air-fuel ratio illustrated in FIG. 3, the limited output torque on a high load side in the lean burn operation becomes the value indicated at the point D. In this case, when an output torque more than the value indicated at the point D is required, the engine must be operated at the stoichiometric ratio. In other words, when the air-fuel ratio A/F in lean burn operation is fixedly set at 24, a region enabling lean burn operation is narrowed. This makes it difficult to improve the fuel consumption.

On the other hand, if the air-fuel ratio A/F in lean burn operation is fixedly set at 20, the region enabling lean burn operation is extended from the point D to the point C. However, in an area on the left side of the point D, an air amount is less than that in the case of the air-fuel ratio A/F=24, the fuel consumption is made poor and the exhaust amount of NOx is increased.

Consequently, it becomes apparent that the fuel consumption/the exhaust amount of NOx on a low load side is incompatible with the fuel consumption/extension of lean burn operation on a high load side with respect to the air-fuel ratio A/F.

Figure 5:
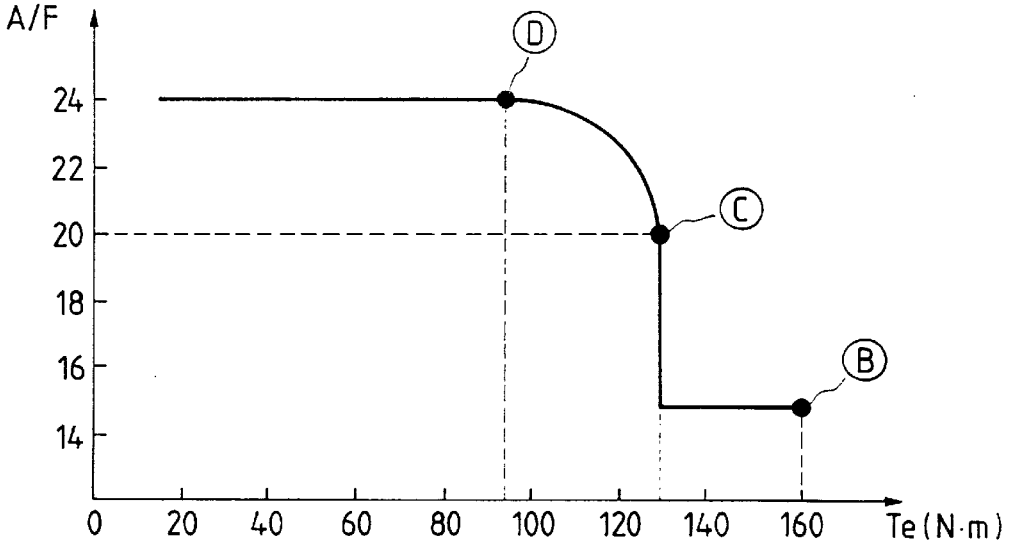
FIG. 5 is a graph showing a relationship between an output torque of an engine and an air-fuel ratio according to the present invention.

To solve such an incompatibility, it is advantageous to change the air-fuel ratio A/F in a lean ratio region, instead of simple switching between the stoichiometric operation and the lean operation as in the related art. For example, referring to FIG. 4, the air-fuel ratio A/F is set at 24 for a torque less than the point D; it is gradually reduced for a torque in a range of from the point D to the point C; it is set at 20 for a torque indicated at the point C; and it is set at the stoichiometric ratio for a torque in a range of from the point C and the point B. The set values of the air-fuel ratio A/F are shown in FIG. 5. It is to be noted that the output torque Te and the air-fuel ratio A/F in FIG. 5 are set to correspond to the engine speed Ne=2000 rpm in FIG. 4.

In FIG. 5, the air-fuel ratio A/F is gradually reduced between the point D and the point C, and is directly set at the stoichiometric ratio over the point C for preventing the concentration of NOx from exceeding the allowable upper limit.

Then, the fuel supply amount is controlled by the control unit 15 in order to obtain the relationship between the output torque of the engine and the air-fuel ratio A/F shown in FIG. 5.

Incidentally, the addition of a new sensor for detecting a torque of the engine is inconvenient in economical consideration. In the following embodiments of the present invention, it is contrived that the above control can be obtained using the system shown in FIG. 1 without provision of any new torque sensor. This is effective for cost saving.

Figure 6:
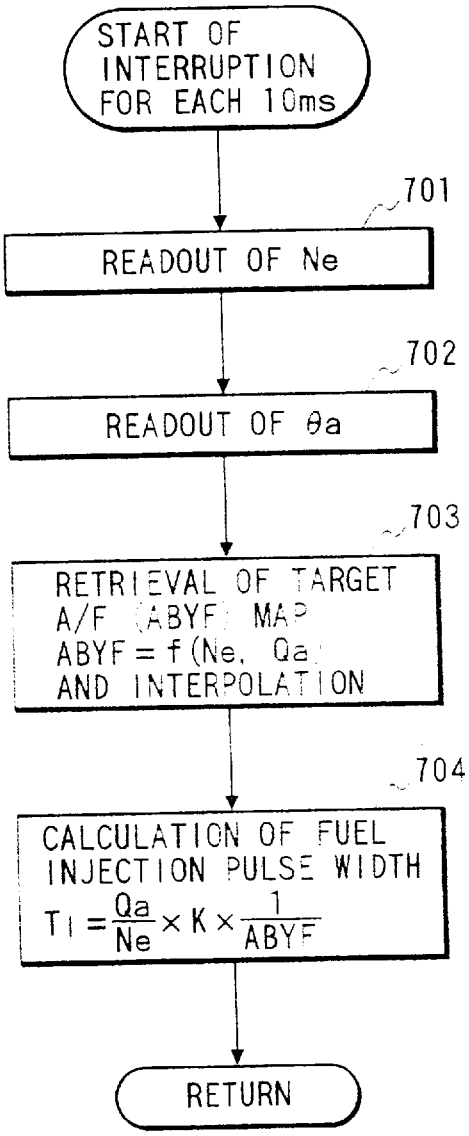
FIG. 6 is a flow chart illustrating the control according to a first embodiment of the present invention.

First, a first embodiment is shown in FIGS. 6, 7, in which an intake air flow signal inputted from the air flow sensor 3 is used for detecting an engine load.

In this embodiment, a set air-fuel ratio A/F is obtained from a two-dimensional map indicating the engine speed Ne and the output torque Te on the basis of a software executed in a MPU 28 of the control unit 15.

FIG. 6 is a flow chart indicating a processing for setting an air-fuel ratio by the control unit 15 according to the first embodiment. The processing is repeatedly executed for unit time of 10 ms by time interruption using a timer as shown in FIG. 6. FIG. 7 shows a map used for setting an air-fuel ratio in this embodiment.

In FIG. 6, the engine speed Ne is readout at a processing block 701, and an intake air amount Qa is readout from data supplied from the air flow sensor 3 at a processing block 702. Next, at a processing block 703, a target air-fuel ratio ABYF is retrieved from the map shown in FIG. 7 on the basis of the engine speed Ne and the intake air amount Qa readout in the processing blocks 701, 702. In this case, when the target air-fuel ratio cannot be directly retrieved in the map, it is determined by smooth interpolation. Finally, a fuel injection pulse width $T_1$ is calculated using the target air-fuel ratio ABYF thus obtained at a processing block 704. Here, a point C and a point D in the map shown in FIG. 7 correspond the point C and the point D in FIG. 5, respectively.

As a result, according to the first embodiment, even in a high load region in which a necessary load exceeds the load limit in the lean ratio region and thereby the engine must be operated at the stoichiometric ratio switched from the lean ratio region, an air amount is small because an air-fuel ratio is made rich, so that as shown in FIG. 3, the engine can be continuously operated in the lean ratio state without degradation of an exhaust gas, to thereby improve the fuel consumption.

Next, a second embodiment of the present invention will be described with reference to FIGS. 8, 9, in which an intake air amount Tp per unit cylinder is used for detecting an engine load.

Figures 8, 9:
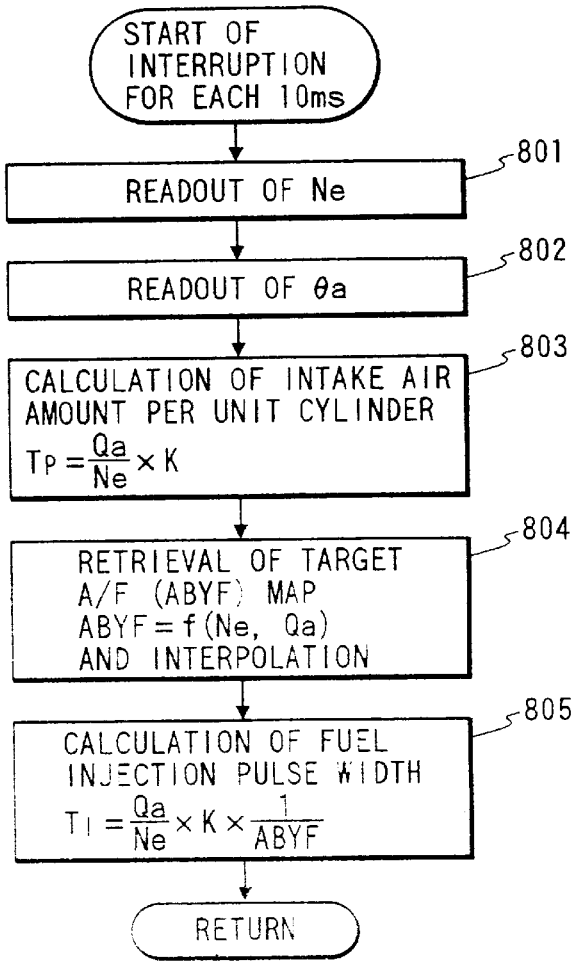
FIG. 8 is a flow chart illustrating the control of a second embodiment of the present invention.
FIG. 9 shows an air-fuel map used for the control of the second embodiment of the present invention.

FIG. 8 is a flow chart showing a processing for setting an air-fuel ratio by the control unit 15 in this embodiment; and FIG. 9 shows a map used for setting an air-fuel ratio.

In FIG. 8, the engine speed Ne is readout at a processing block 801, and an intake air amount Qa is readout at a processing block 802. The intake air amount Tp per unit cylinder is calculated at a processing block 803. Next, at a processing block 804, a target air-fuel ratio ABYF is retrieved from the map shown in FIG. 9 on the basis of the engine speed Ne and the intake air amount Tp per unit cylinder. In this case, when the target air-fuel ratio cannot be directly retrieved in the map, it is determined by smooth interpolation. Finally, a fuel injection pulse width T1 is calculated using the target air-fuel ratio ABYF thus obtained at a processing block 805.

The processing shown in FIG. 8 is executed by time interruption for each 10 ms.

The control shown in FIG. 5 can be thus obtained in this embodiment, so that an air-fuel ratio is made rich in a high load region even during lean burn operation, with a result that the engine can be continuously operated in the lean ratio state, to thereby improve the fuel consumption without degradation of an exhaust gas.

In this embodiment, the same effect can be obtained using an air-fuel ratio map in which the intake air amount Tp per unit cylinder shown in FIG. 9 is replaced with an opening degree of an accelerator pedal. For an electronic control throttle valve type engine control system, the same effect can be obtained using an air-fuel ratio map in which the intake air amount Tp per unit cylinder shown in FIG. 9 is replaced with an opening degree of an throttle valve.

A third embodiment of the present invention will be described with reference to FIGS. 10 to 12.

As described above, upon lean burn operation in a wide lean ratio region, the limited air-fuel ratio corresponds to the allowable limit of combustion stability shown in FIG. 3, and it is dependent on an operation condition determined by an engine speed, output torque and the like. Such an operational condition, however, can be measured or estimated, and a map in which air-fuel ratios are set with respect to the operational conditions is used in each of the embodiments 1 and 2.

However, there is a fear that the limited air-fuel ratio is changed depending on factors impossible to be detected or estimated by the control unit 15, for example, inherent characteristic of an engine, the degree of deterioration of an ignition plug, and the like. To solve such a fear, according to a third embodiment, a combustion stability, that is, a torque variation $\Delta\tau$ shown in FIG. 3 is monitored for making rich, by feedback control, an airfuel ratio in a lean ratio region in such a range that the torque variation $\Delta\tau$ thus monitored does not exceed the allowable upper limit. Namely, in the third embodiment, the torque variation $\Delta\tau$ of the engine, that is, a surge torque is detected, and a target air-fuel ratio is obtained in accordance with the magnitude of the surge torque using two kinds of air-fuel ratio maps switched from each other, to calculate the fuel injection time $T_1$ of the fuel injection valve 13.

Figure 10:
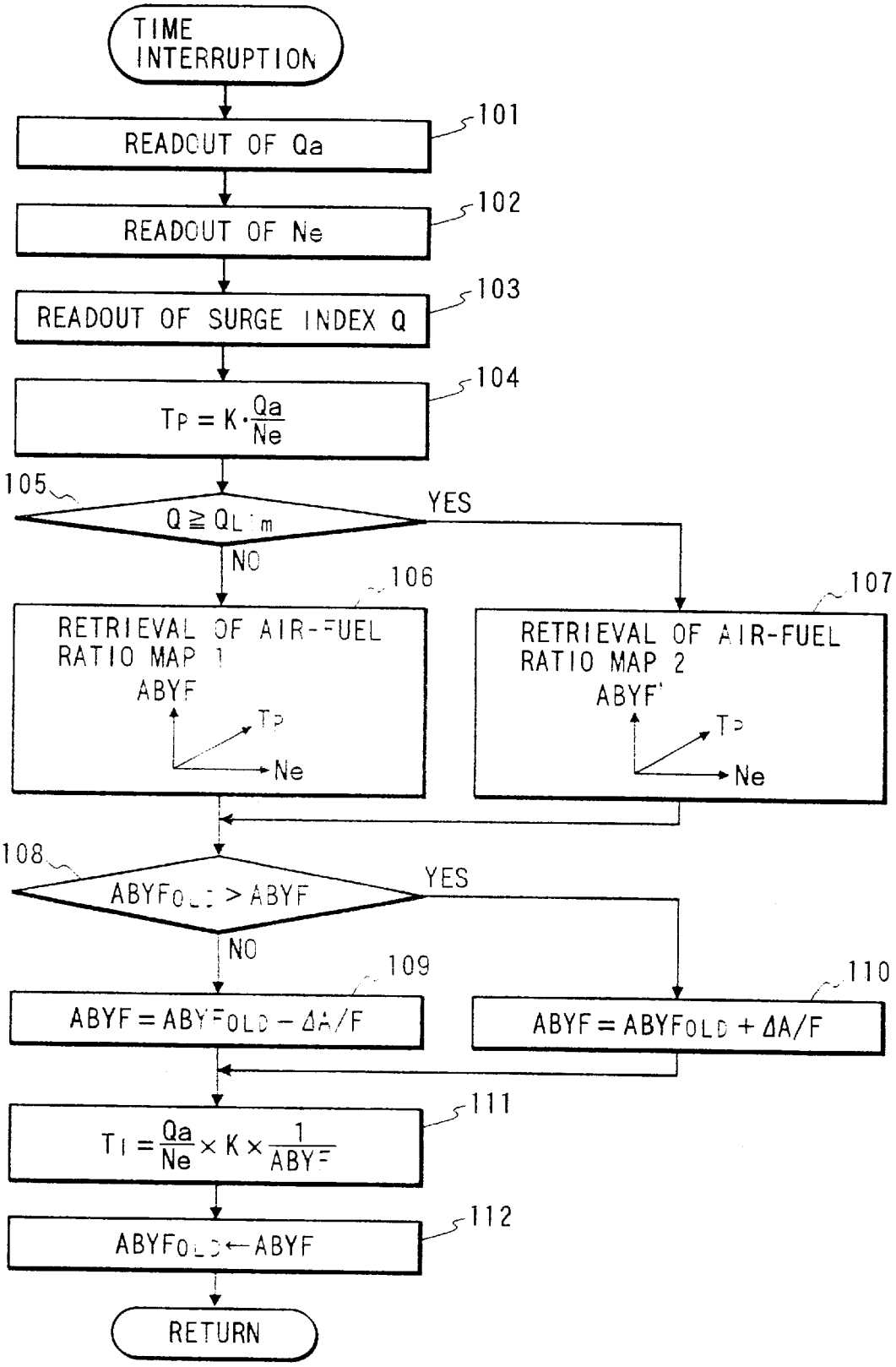
FIG. 10 is a flow chart illustrating the control of a third embodiment of the present invention.

FIG. 10 is a flow chart showing a processing for calculating the fuel injection time $T_1$ of the fuel injection valve 13 according to this embodiment. An intake air amount Qa is readout at a processing block 101, and an engine speed Ne is readout at a processing block 102. A surge index Q is readout at a processing block 103. In addition, the calculation of the surge index will be described later. An intake air amount Tp per unit cylinder is obtained at a processing block 104. It is judged at a judging block 105 whether or not the surge index Q is larger than a specified value $Q_{Lim}$. If the surge index Q is judged to be not more than the specified value $Q_{Lim}$, an air-fuel ratio map 1 is retrieved at a processing block 106 to obtain a target air-fuel ratio ABYF' by the air-fuel ratio map 1. On the other hand, if the surge index Q is judged to be larger than the specified value $Q_{Lim}$, an air-fuel ratio map 2 is retrieved at a processing block 107 to obtain a target air-fuel ratio ABYF' by the air-fuel ratio map 2. The air-fuel ratio maps 1, 2 will be described later.

The target air-fuel ratio $ABYF_{OLD}$ upon the preceding interruption is compared with the target air-fuel ratio ABYF' obtained by the present retrieval of the map, and the process advances to a processing block 109 or a processing block 110 in accordance with the comparison result. A specified value $\Delta A/F$ is subtracted from or added to the target air-fuel ratio ABYFOLD at the processing block 109 or 110 for making the target air-fuel ratio ABYFOLD close to the ABYF' side by the specified value $\Delta A/F$.

The fuel injection time $T_1$ of the fuel injection valve 13 is calculated, at a processing block 111, on the basis of the target air-fuel ratio ABYF finally obtained in the above processing. The target air-fuel ratio $ABYF_{OLD}$ is renewed.

The reason why the judging block 108 and the processing blocks 109, 110 are provided is as follows. In this embodiment, since the air-fuel ratio map to be retrieved is switched depending on the surge index Q, the target air-fuel ratio is abruptly changed in switching of the air-fuel ratio map. Such an abrupt change in the target air-fuel ratio tends to abruptly change the torque, leading to occurrence of shock. For this reason, the judging block 108, and the processing blocks 109, 110 are provided for gradually changing the target air-fuel ratio.

Figure 11:
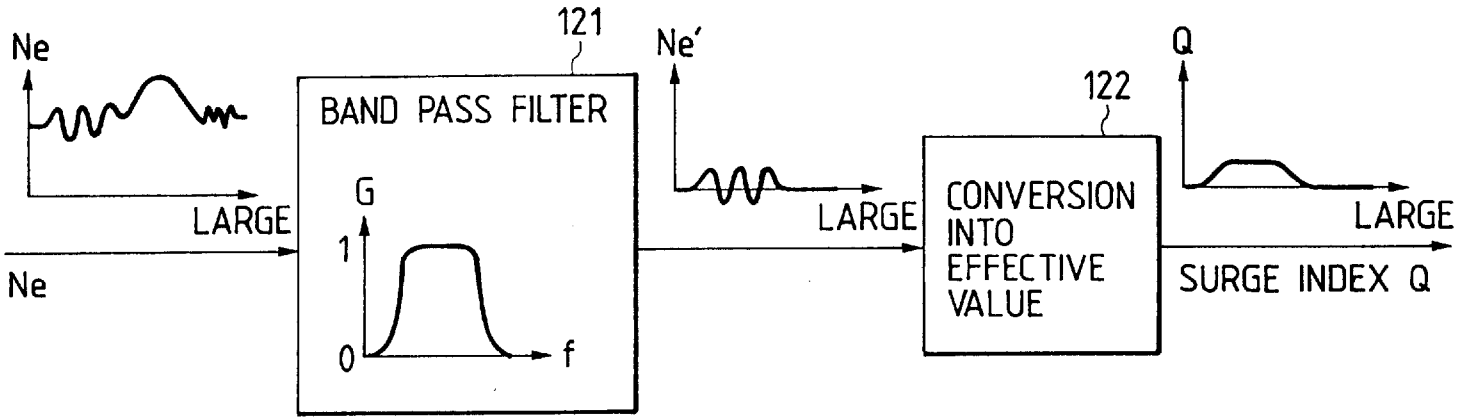
FIG. 11 is a block diagram illustrating the processing for obtaining a surge index in the control of the third embodiment of the present invention.

FIG. 11 shows a processing for detecting the surge index Q readout in the processing block 103 shown in FIG. 10 on the basis of variations in engine speed. The engine speed Ne is inputted in a band pass filter 121. The passing band area of the band pass filter 121 is set at a value in a range of from 1 to 9 Hz.

Only a surge torque component of a signal passes the band pass filter 121, which is then inputted in an effective valve conversion means 122 to be converted into an effective value, thus obtaining the surge index Q indicating the surge torque.

The processing for detecting the surge index Q is executed in the MPU 28 in the control unit 15. The processing period may be determined by time interruption or engine speed interruption.

Figure 12:
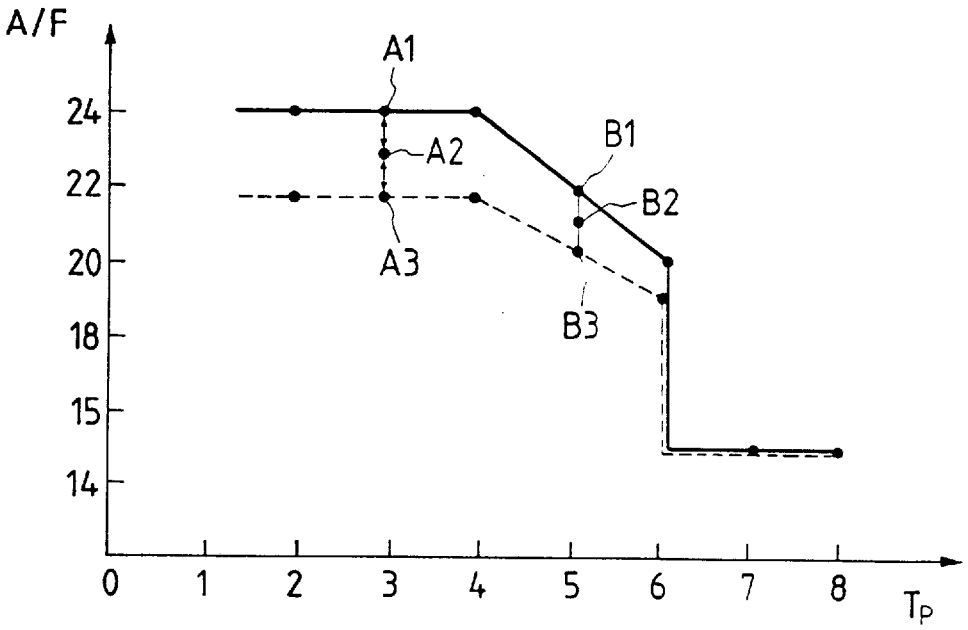
FIG. 12 is a graph illustrating an air-fuel ratio map used in the control of the third embodiment of the present invention.

FIG. 12 shows the two air-fuel ratio maps 1, 2 in sections taken on a certain engine speed. A solid line passing through points A1, B1 indicates a characteristic of the air-fuel ratio map 1 for giving a target air-fuel ratio when a surge torque is not more than a specified value. On the other hand, a broken line passing through points A3, B3 indicates a characteristic of the air-fuel ratio map 2 for giving a target air-fuel ratio when a surge torque is more than the specified value.

The shift between the air-fuel ratio maps 1 and 2 is moderately performed in sequence, for example, from a point A2 to a point B2 by provision of the judging block 108 and the processing blocks 109, 110.

Accordingly, in the third embodiment, even when the characteristic of the torque variation $\Delta\tau$ shown in FIG. 3 is changed by factors impossible to be detected or estimated by the control unit 15, such as an inherent property of an engine and the degree of deterioration of an ignition plug, and the torque variation $\Delta\tau$ comes close to the allowable upper limit of combustion stability although an air-fuel ratio A/F is less than 24, the control shown in FIG. 5 can be usually performed in a stable combustion state because the control based on the air-fuel ratio map 1 is gradually shifted to the control based on the air-fuel ratio map 2 depending on the increased surge index Q.

Thus, an air-fuel ratio is made rich in a high load region even during lean burn operation, so that the engine can be continuously operated in a lean ratio state, to thereby improve the fuel consumption without deterioration of an exhaust gas.

As described above, according to the present invention, even in a high load accelerating region where an engine must be operated at a stoichiometric ratio switched from a lean ratio region in the related art, the engine can be operated in the lean ratio region. This is effective to increase a lean operation region of a lean burn engine, and hence to improve the fuel consumption thereof.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An engine control device in which an air-fuel ratio of said engine is adjusted to one of a group of ratio values including a stoichiometric ratio and a lean ratio, comprising:

an air-fuel ratio control unit which adjusts a present lean air-fuel ratio of said engine to a predetermined lean air-fuel ratio which is richer than said present lean air-fuel ratio, when a present engine load is more than a predetermined maximum load which can be generated by said present lean air-fuel ratio at a present engine speed;

wherein said air-fuel ratio control unit maintains said predetermined lean air-fuel ratio when a present engine load is less than or equal to a predetermined maximum load at present engine speed when said engine is operated at said predetermined lean air-fuel ratio.

2. An engine control device according to claim 1, wherein said air-fuel ratio control unit computes a magnitude of said present engine load on the basis of information supplied from a sensor for detecting an intake air amount of said engine.

3. An engine control device according to claim 1, wherein said air-fuel ratio control unit computes said magnitude of said engine load on the basis of an intake air amount per unit cylinder which is obtained by dividing an intake air amount of said engine by an engine speed, said intake air amount of said engine being supplied from a sensor for detecting said intake air amount of said engine.

4. An engine control device according to claim 1, wherein said air-fuel control unit computes a magnitude of said engine load on the basis of information supplied from a sensor for detecting an opening degree of a throttle valve for adjusting an intake air amount of said engine.

5. An engine control device according to claim 1, wherein said air-fuel control unit changes a value of said lean ratio on the basis of information supplied from a means for detecting a variation width of an output torque of said engine.

6. An engine control device according to claim 1, wherein said air-fuel ratio control unit changes a present air-fuel ratio to a next predetermined lean air-fuel ratio in order of increasing of an engine load.

* * * * *